US008608489B2

(12) United States Patent
Nogami et al.

(10) Patent No.: US 8,608,489 B2
(45) Date of Patent: Dec. 17, 2013

(54) AC ADAPTOR AND METHOD FOR FABRICATING THE SAME

(75) Inventors: Haruyoshi Nogami, Fukuoka (JP); Akifumi Hanada, Fukuoka (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 540 days.

(21) Appl. No.: 12/372,826

(22) Filed: Feb. 18, 2009

(65) Prior Publication Data

US 2009/0209133 A1 Aug. 20, 2009

(30) Foreign Application Priority Data

Feb. 19, 2008 (JP) ..... P2008-036766

(51) Int. Cl.
*H01R 12/00* (2006.01)

(52) U.S. Cl.
USPC ..... 439/76.1; 439/377

(58) Field of Classification Search
USPC ..... 439/620.06, 620.15, 76.1, 856, 64, 377
See application file for complete search history.

(56) References Cited

U.S. PATENT DOCUMENTS 6,123,587 A * 9/2000 Beloritski et al. ..... 439/857
6,478,599 B1 * 11/2002 McHugh et al. ..... 439/342
6,551,143 B2 * 4/2003 Tanaka et al. ..... 439/682
6,644,984 B2 * 11/2003 Vista et al. ..... 439/76.1
7,270,551 B2 * 9/2007 Busse et al. ..... 439/76.1

FOREIGN PATENT DOCUMENTS

JP 04-102578 U 3/1992
JP 07-312243 A 11/1995
JP 9-7723 1/1997

OTHER PUBLICATIONS

Japanese Office Action for counterpart Japanese Patent Application 2008-036766, Jul. 31, 2012.

* cited by examiner

*Primary Examiner* — Felix O Figueroa
(74) *Attorney, Agent, or Firm* — Whitham Curtis Christofferson & Cook, PC

(57) ABSTRACT

An AC adaptor is disclosed, a plug extends in a first direction so as to penetrate a part of a case. A circuit board is disposed within the case. A contact terminal is disposed on the circuit board, and elastically contacts an end portion of the plug (without being soldered thereon). A first regulator is disposed within the case and regulates a position of the circuit board in a second direction orthogonal to the first direction. A second regulator is disposed within the case and regulates a position of the circuit board in a third direction orthogonal to the first direction and the second direction.

5 Claims, 7 Drawing Sheets

AC ADAPTOR AND METHOD FOR FABRICATING THE SAME

BACKGROUND

The present invention relates to an AC adapter and a method for fabricating the AC adaptor and more particularly to an AC adaptor which is made up of a case with plugs and a printed circuit board which is built into the case and a method for fabricating the AC adaptor.

Conventionally, an AC adaptor of this type is made up of a case in which a pair of plugs are provided and a printed circuit board which is built into the case. A related-art of such an AC adaptor is shown in FIG. 9. In FIG. 9, reference numeral 1 denotes a case which is made from a synthetic resin, and a pair of plugs (not shown) is provided fixed in the case 1 through molding.

Root side portions of the plugs are made to project inwards by a small amount from an inner surface of the case 1, and fixed contact pieces 2 are provided on the projecting portions, respectively. In addition, a printed circuit board 3 is built into the case 1, and the printed circuit board 3 has an electronic parts mounting surface and a wiring patterns laying out surface. Contact terminals 4 are provided on the printed circuit board 3, and the contact terminals 4 are electrically connected to the fixed contact pieces 2 on the plugs side (the case side), respectively, via corresponding wires 5.

In the AC adaptor, when building the printed circuit board 3 into the case 1, both ends of the respective wires 5 are soldered to the fixed contact pieces 2 on the plugs sides and the contact terminals 4 on the printed circuit board 3 side, and the printed circuit board 3 is inserted into a predetermined position within the case 1 for incorporation therein. Then, after the printed circuit board 3 has been so built into the case 1, the wires 5 are laid out properly (for example, refer to FIG. 4 of Japanese Patent Publication No. 9-7723A).

DISCLOSURE OF THE INVENTION

Problem that the Invention is to Solve

In the conventional AC adaptor, since the fixed contact pieces 2 on the plugs sides and the contact terminals 4 on the printed circuit board 3 side are connected to each other by the wires 5 for incorporation of the printed circuit board 3 into the housing 1, the fabrication efficiency is lowered due to the building-in work of the printed circuit board 3 being troublesome and the soldering and laying out operations of the wires 5 taking a long time.

In view of the above, it is considered to bring the fixed contact pieces on the plugs sides and the contact terminals on the printed circuit board side into direct press contact with each other for electrical connection. In this case, however, since the fixed contact pieces and the contact terminals are electrically connected depending only upon the press contact force, it is difficult to maintain a stable electrical connection between the fixed contact pieces and the contact terminals.

In particular, by the printed circuit board being caused to be offset relative to the case when or after the printed circuit board is built into the case, the stability in electrical connection is lowered, and the performance and quality of the AC adaptor would be lowered.

SUMMARY

It is therefore one advantageous aspect of the invention to provide an AC adaptor that makes the building-in work of the printed circuit board easy to increase the productivity and ensures the stability in electrical connection between the fixed contact pieces on the plugs sides and the contact terminals on the printed circuit board at all times.

According to one aspect of the invention, there is provided an AC adaptor, comprising:

a case;

a plug, extending in a first direction so as to penetrate a part of the case;

a circuit board, disposed within the case;

a contact terminal, disposed on the circuit board, and elastically contacting an end portion of the plug (without being soldered thereon);

a first regulator, disposed within the case and regulating a position of the circuit board in a second direction orthogonal to the first direction;

a second regulator, disposed within the case and regulating a position of the circuit board in a third direction orthogonal to the first direction and the second direction.

The AC adaptor may be configured such that: the first regulator includes a rail extending in the first direction and contacting a side edge of the circuit board in the second direction.

The AC adaptor may be configured such that: the second regulator is protruded from an inner face of the case in the third direction.

The AC adaptor may be configured such that: the second regulator has a slope being away from the inner face of the case as being close to the plug.

The AC adaptor may be configured such that: a third regulator, disposed within the case and regulating a position of the circuit board in the first direction and contacting a side edge of the circuit board in the first direction.

The AC adaptor may be configured such that: the contact terminal has a shape for clamping the end portion of the plug.

According to one aspect of the invention, there is provided a method of mounting a circuit board to a case of an AC adaptor, comprising:

providing a case with a plug extending in a first direction so as to penetrate a part thereof;

providing a circuit board having a contact terminal;

inserting the circuit board into the case;

moving the circuit board within the case toward the plug in the first direction;

causing the contact terminal to come into elastic contact with an end portion of the plug under a condition that a position of the contact terminal in a second direction and a third direction which are orthogonal to the first direction is regulated (without being soldered on the plug).

The method may be configured such that: the position of the circuit board in the third direction is regulated by causing a side edge of the circuit board in the third direction to slide on a rail disposed within the case and extending in the first direction.

The method may be configured such that: the position of the circuit board in the second direction is regulated by causing the circuit board to slide on a slope disposed within the case and being away from an inner face of the case as being close to the plug.

The method may be configured such that: a position of the contact terminal in the first direction is regulated when the contact terminal comes into elastic contact with the end portion of the plug.

DETAILED DESCRIPTION OF EXEMPLIFIED EMBODIMENTS

Figure 1:
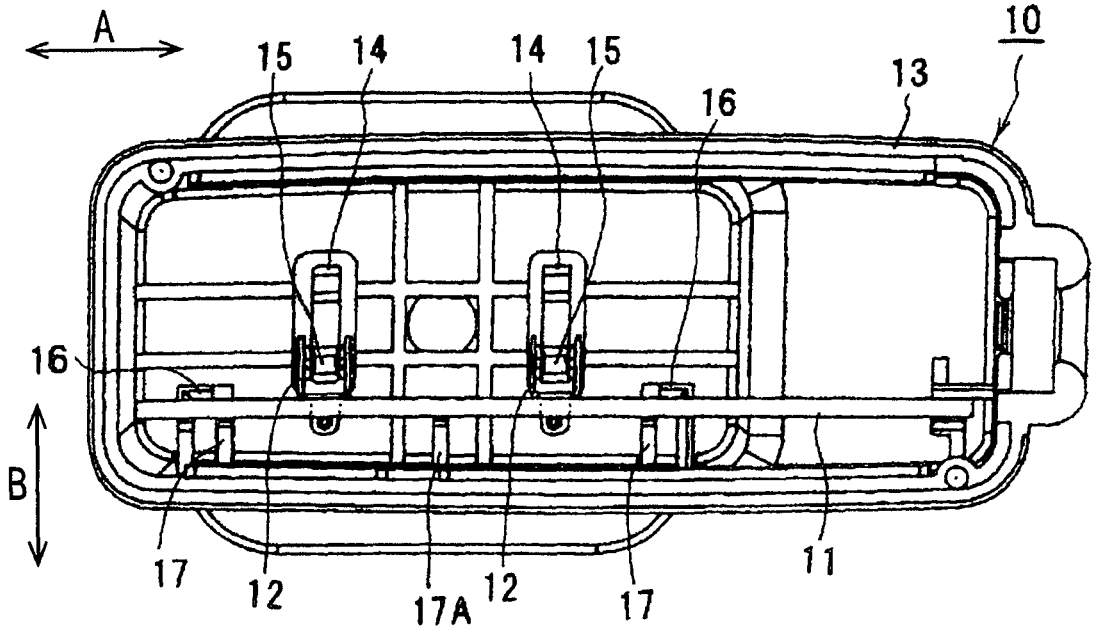
FIG. 1 is a front view showing the inside of an AC adaptor according to an embodiment of the present invention.

With a view to attaining the object to facilitate the building in work of the printed circuit board so as to increase the productivity and to ensure the stability in contact between the fixed contact pieces portions on the case side and the contact terminals on the printed circuit board side at all times, the invention realizes attainment of the object by providing an AC adaptor in which a printed circuit board is built in a case with plugs and contact terminals provided on the printed circuit board and fixed contact pieces formed on root side end portions of the plugs are electrically connected, wherein the contact terminals are formed by a spring material so as to be brought into elastic pressure contact with the fixed contact pieces and a position restricting projection in a thickness direction for restricting the position of the printed circuit board in the thickness direction and a position restricting projection in a width direction for restricting the position of the printed circuit board in the width direction relative to the case are provided on the case side.

Hereinafter, a preferred embodiment of the invention will be described below in detail with reference the accompanying drawings. In this embodiment, a position restricting projection in a thickness direction and a position restricting projection in a width direction may be provided independently of each other or may be provided integrally with each other. In addition, directions indicated by arrows A denote a width direction of a printed circuit board, and directions indicated by arrows B denote a thickness direction of the printed circuit board. In addition, in FIG. 2, a direction indicated by an arrow C denotes an inserting direction of the printed circuit board.

In the figures, reference numeral 10 denotes an AC adaptor for converting an alternating current power supply into a direct current power supply. A housing of the AC adaptor 10 is formed into a flat box shape, and a printed circuit board 11 having an L shape as viewed from the top is built in the housing. Various types of electronic components such as capacitors (not shown) are mounted on a front surface of the printed circuit board 11 and wiring patterns are formed on a back surface of the printed circuit board 11.

In addition, contact terminals 12 of the wiring patterns are provided in two locations in the vicinity of a front end portion in a printed circuit board inserting direction C on the surface of the printed circuit board 11 in such a manner as to be erected therefrom. These contact terminals 12 confront and are spaced apart from each other in the width direction A, and a distance between the contact terminals 12 so spaced apart from each other corresponds to an interval between a pair of plugs (blades) on a case 13 side. The case 13 will be described later on. The contact terminals 12 are each formed of a plate-shaped spring material into a U-shape (including an angular U-shape), so as to hold respectively fixed contact pieces 15 on the plugs 14 sides therebetween with a required press contact force for elastic contact. Each of the contact terminals 12 may include a projection adapted to be abutted against the contact pieces 15. The shape of the projection may be semi-spherical, circular conical or pyramidal.

Figure 2:
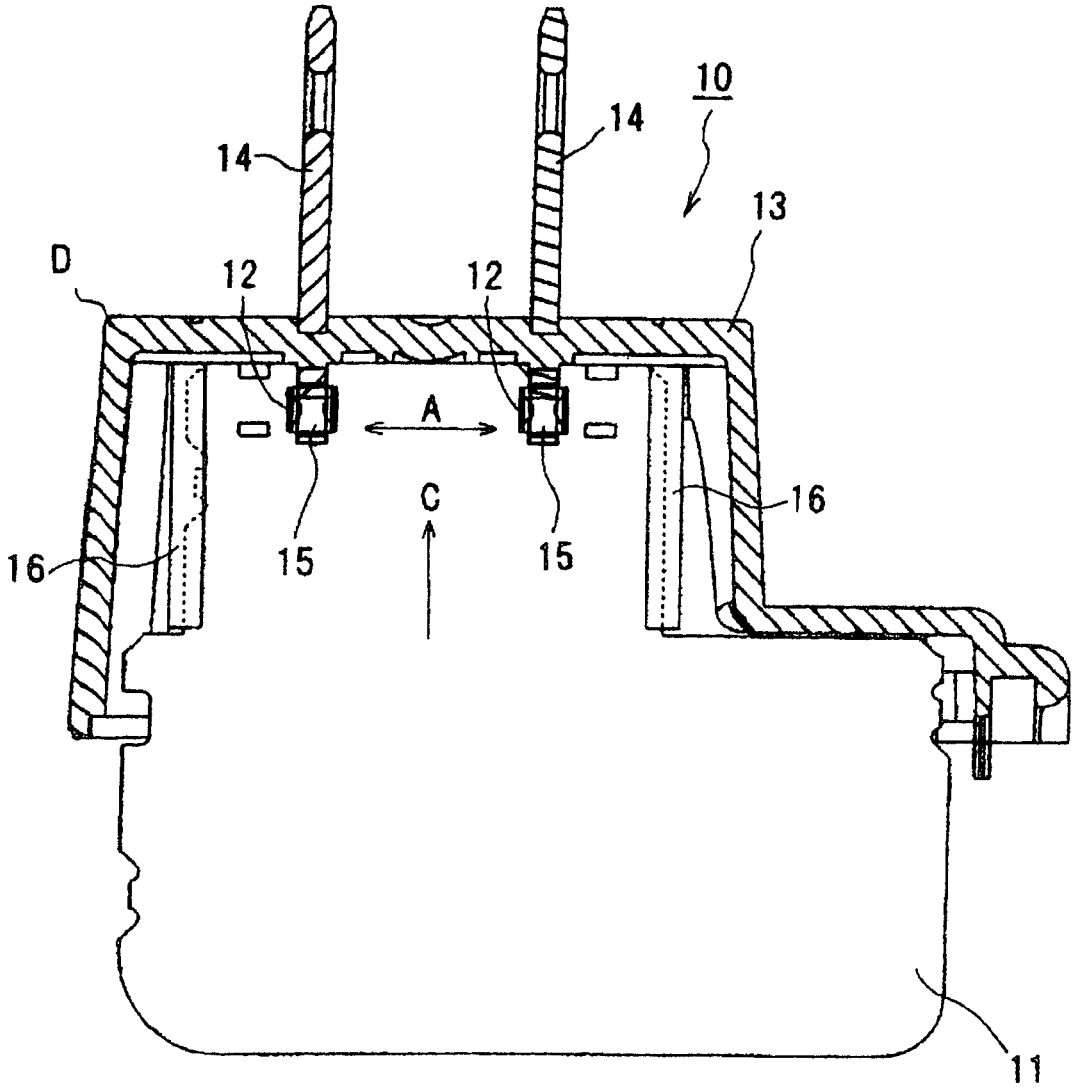
FIG. 2 is a plane cross section view of FIG. 1.
Figure 3:
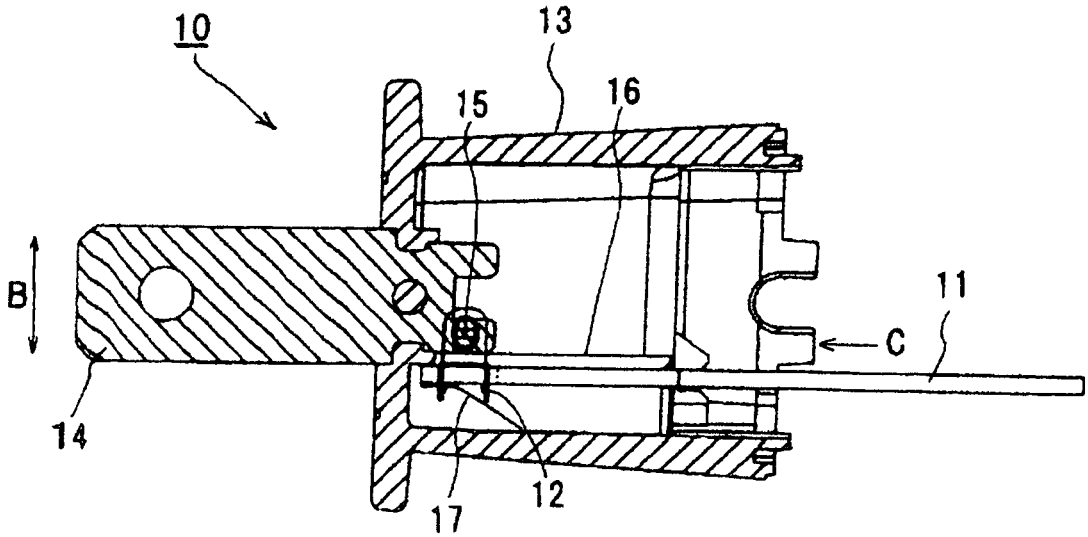
FIG. 3 is a side cross section view of FIG. 1.

In addition, the housing of the AC adaptor 10 is made up of one half case 13 which is made from a synthetic resin and is opened on a side from which the printed circuit board 11 is inserted and the other half case (not shown) which are built into each other. As is shown in FIG. 2, the case 13 is formed into a stepped shape having a turned angular U-shape portion D as viewed from the top, and the printed circuit board 11 is made to be inserted into the case 13 from an opposite side to a side where the plugs 14 are provided so as to be built therein.

The pair of plugs 14 are installed securely by integrating the pair in the turned angular U-shape portion D of the case 13 by resin molding, and root side end portions of the plugs 14 are made to extend from an outer surface of the case 13 in the printed circuit board inserting direction C.

The root side end portions of the plugs 14 are made to slightly project inwards of the case 13 from an inner surface of the case 13, and the fixed contact pieces 15 are provided respectively on projecting ends of the plugs 14. As has been described above, the fixed contact pieces 15 are electrically connected to the contact terminals 12 on the printed circuit board 11 side.

In addition, position restricting projections 16 in a width direction are provided integrally on an inner surface side of the turned angular U-shape portion D on a bottom surface of the case 13 in such a manner as to be erected therefrom. These position restricting projections 16 in the width direction are each formed by a rail-shaped rib and are, as is shown in FIG. 2, made to extend in parallel with both side inner wall surfaces of the turned angular U-shape portion D of the case 13 in the printed circuit board inserting direction C. The position restricting projections 16 in the width direction are each formed to have an L-shaped vertical cross section and each have a vertical portion and a horizontal portion which continuously connects to an upper end of the vertical portion at right angles.

End portions in the width direction of the printed circuit board 11 slidably fit between the position restricting projections 16 at lower surface sides thereof. Consequently, in building in the printed circuit board 11, the position restricting projections 16 serve as guide means for guiding a movement of the printed circuit board 11 in the inserting direction thereof.

In addition, the horizontal portions of the position restricting projections 16 double as position restricting members in a thickness direction of the printed circuit board 11, and an upward movement of the printed circuit board 11 in the thickness direction B is restricted by the horizontal portions.

Furthermore, position restricting projections 17 in a thickness direction are provided integrally on insides of the position restricting projections 16, respectively, on the bottom surface of the case 13 in such a manner as to be erected therefrom. Respective upper sides of the position restricting projections 17 are each formed substantially into a U shape or a V shape as viewed from the side and each have an upwardly inclined surface portion and a horizontal surface portion which continuously connects to an upper end of the upwardly inclined surface portion.

In this embodiment shown in the figures, a position restricting projection 17A in the thickness direction is also provided in a location on the bottom surface of the case 13 which corresponds to a central portion of the printed circuit board 11 in the width direction. By this configuration, by a lower surface of the printed circuit board 11 being brought into abutment with the horizontal surface portions of the position restricting projections 17, 17A, a downward movement of the printed circuit board 11 in the thickness direction is restricted.

In addition, a stopper portion (for example, a stopper surface or a rib-like projection), not shown, with which an end face of the printed circuit board 11 in the printed circuit board inserting direction C is to be brought into abutment is provided at a deepest portion in the case 13 in the printed circuit board inserting direction C so as to restrict a building-in position of the printed circuit board 11 in the printed circuit board inserting direction C. Although the position where to form the stopper portion is not limited specifically, for example, stopper portions can be provided on upper sides of the position restricting projections 17, 17A.

Figure 4:
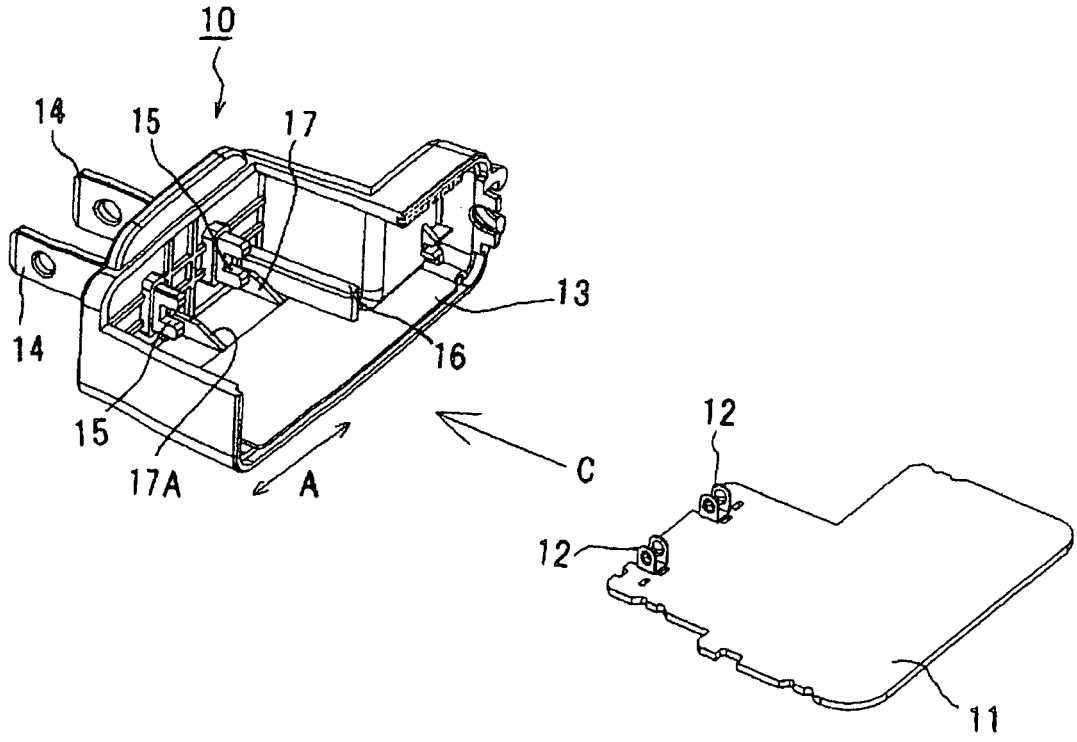
FIG. 4 is a perspective view showing the preassemble mode of an AC adaptor according to the present invention.

In accordance with an exemplary embodiment of the present invention, when building the printed circuit board 11 in the case 13 with the plugs 14, as is shown in FIG. 4, the printed circuit board 11 is inserted in the inserting direction C into the case 13 from a side of the case 13 opposite to a side where the plugs 14 are provided and is slid to the building-in position, whereby the printed circuit board 11 can easily be built in the case 13.

Namely, the end portions of the printed circuit board 11 in the width direction A are fitted in the inside of the pair of position restricting projections 16 and is then pushed inwards until the end face of the printed circuit board 11 in the printed circuit board inserting direction C comes into abutment with the stopper portion. Thus, the position of the printed circuit board 11 relative to the case 13 is restricted in such a manner that the position of the printed circuit board 11 in the thickness direction B is restricted by the position restricting projections 17, 17A, while the position of the printed circuit board 11 in the width direction A is restricted by the position restricting projections 16.

Figure 5:
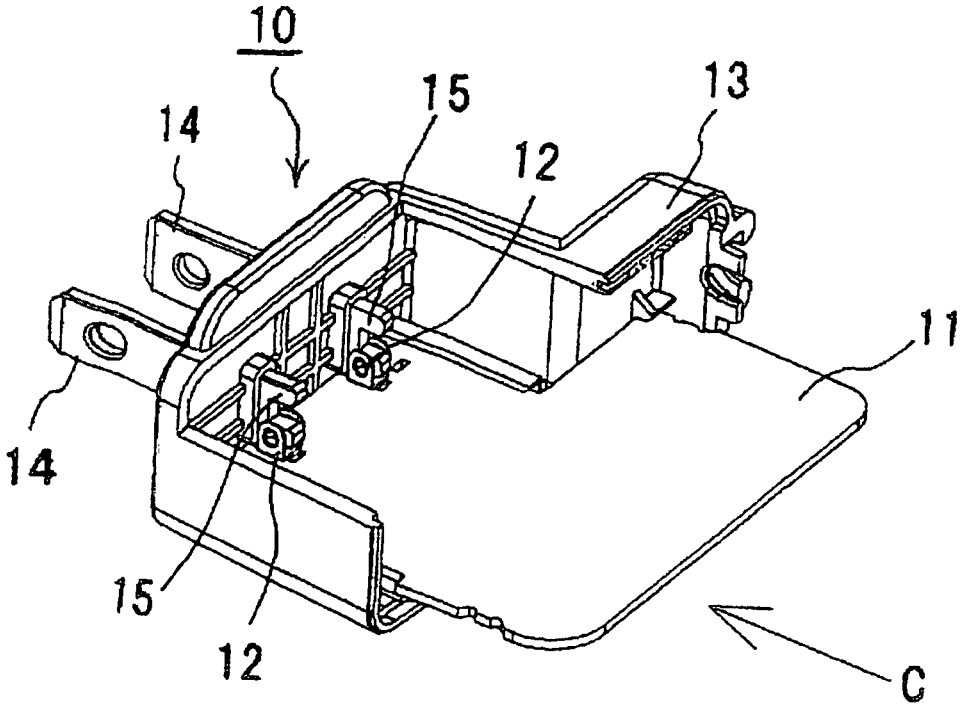
FIG. 5 is a perspective view showing the assembled mode of an AC adaptor according to the present invention.

In addition, as the same time as those positional restrictions are implemented, by the contact terminals 12 on the printed circuit board 11 side being brought into elastic press contact with the fixed contact pieces 15 on the plugs 14 sides, as is shown in FIG. 5, the contact terminals 12 and the fixed contact pieces 15 are brought into direct contact with each other for electrical connection.

Consequently, the invention obviates the necessity of soldering the connecting wires and laying out the connecting wires so soldered in the case which are required in the conventional AC adaptor, and hence, the building in work of the printed circuit board 11 can be performed easily and quickly by adopting the inserting method. Moreover, the accuracy at which the printed circuit board 11 is built in is increased compared with the conventional AC adaptor fabricating method, and hence, the productivity of AC adaptors 10 is remarkably increased.

In addition, when the printed circuit board 11 is built in the case 13, the contact terminals 12 on the printed circuit board 11 side are brought into contact with the fixed contact pieces 15 on the plugs 14 sides with a required press contact force and are then held thereon. Thus, a stable electrically connected state is ensured at all times between the contact terminals 12 and the fixed contact pieces 15.

Further, since the position restricting projections 16 which are provided on both the sides of the printed circuit board 11 in the width direction are each formed into the rail shape having the inverted L-shaped cross section, when the printed circuit board 11 is inserted and built into the case 13, both the side portions of the printed circuit board 11 in the width direction are smoothly guided by the position restricting projections 16 while being fitted in the insides of the pair of position restricting projections, whereby the printed circuit board 11 is allowed to move to the building-in position.

Furthermore, since the restriction of the position of the printed circuit board 11 in the thickness direction B is implemented in the three locations, that is, at both the side portions and the central portion in the width direction of the printed circuit board 11, by the position restricting projections 17, 17A, the positioning accuracy of the printed circuit board 11 in the thickness direction B is increased further.

In this embodiment shown in the figures, since the stopper portion is provided at the deepest portion in the case 13, when the printed circuit board 11 is pushed into the deepest portion in the case 13, the end face of the printed circuit board 11 in the printed circuit board inserting direction C is brought into abutment with the stopper portion to thereby be stopped in the building-in position accurately in the case 13, whereby the positioning of the printed circuit board 11 in the printed circuit board inserting direction C is attained automatically.

In addition, the contact terminals 12 are formed of the spring material into the U-shape. Therefore, the contact terminals 12 are brought into surface contact with the fixed contact pieces 15 on the plugs 14 sides in an ensured fashion in such a state that the contact terminals 12 hold the fixed contact pieces 15, respectively, whereby the stability in electrical contact between the contact terminals 12 and the fixed contact pieces 15 are increased further.

Figure 6:
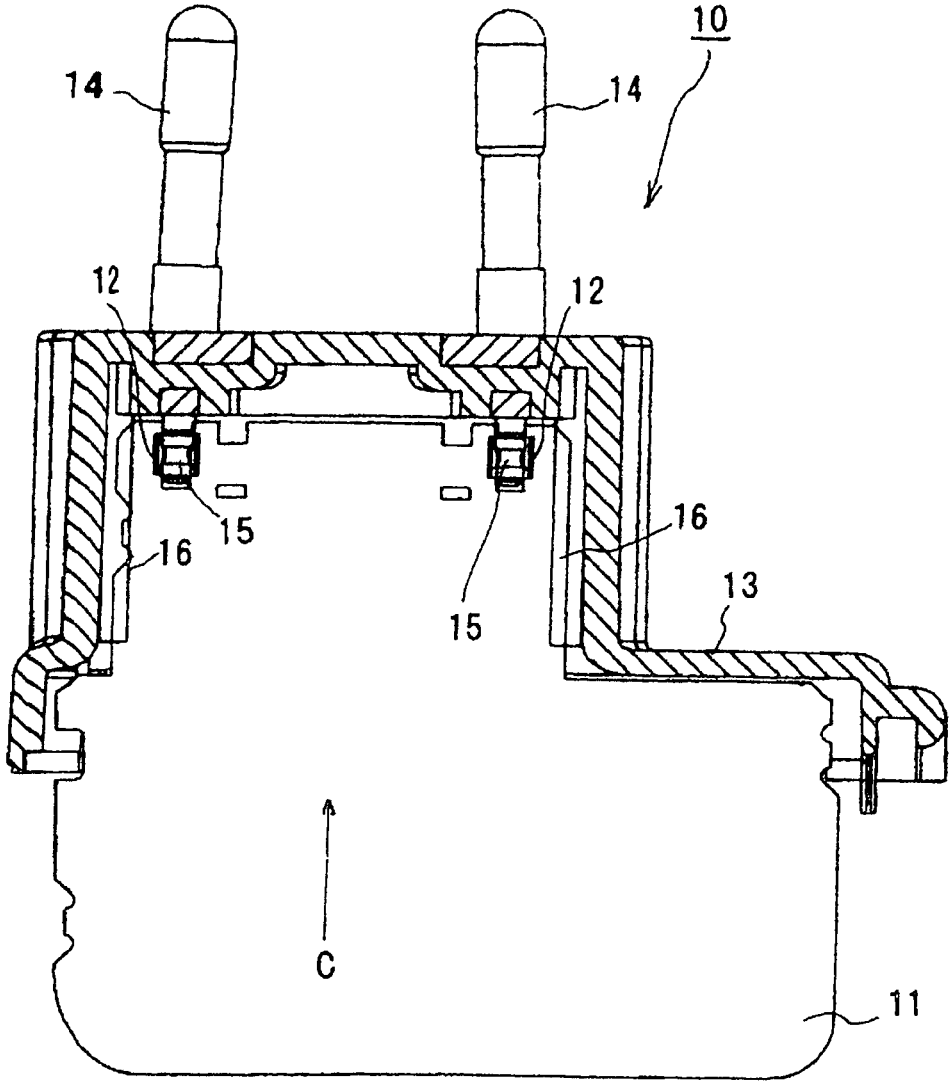
FIG. 6 is a front view showing the inside of an AC adaptor according to another embodiment.
Figure 7:
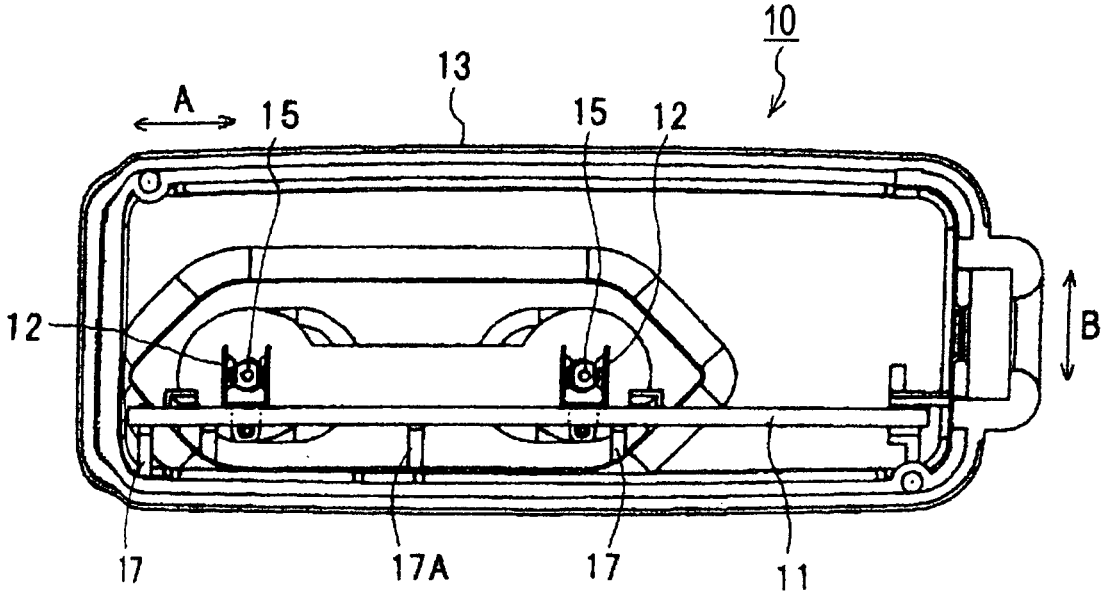
FIG. 7 is a plane cross section view of FIG. 6.
Figure 8:
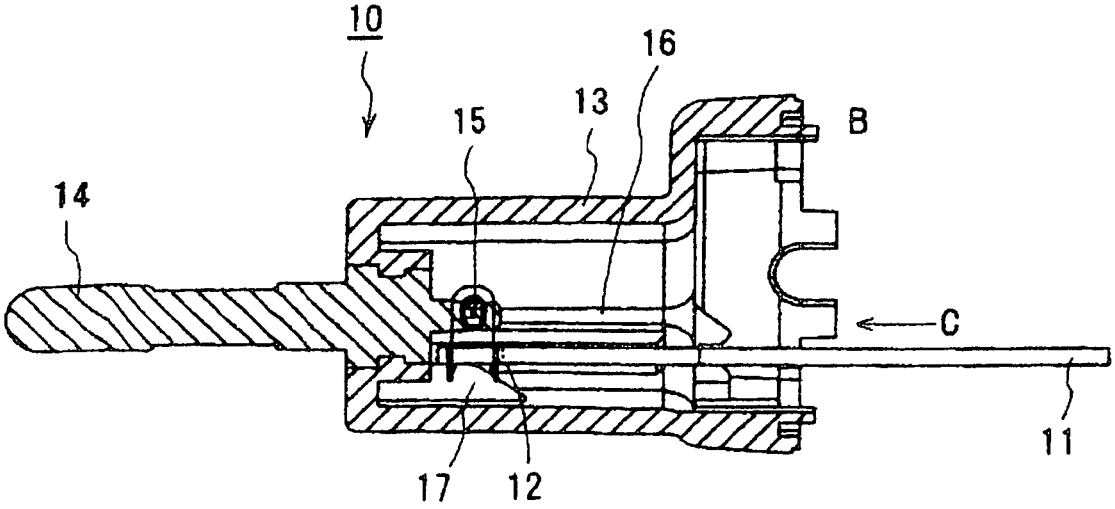
FIG. 8 is a side cross section view of FIG. 6.
Figure 9:
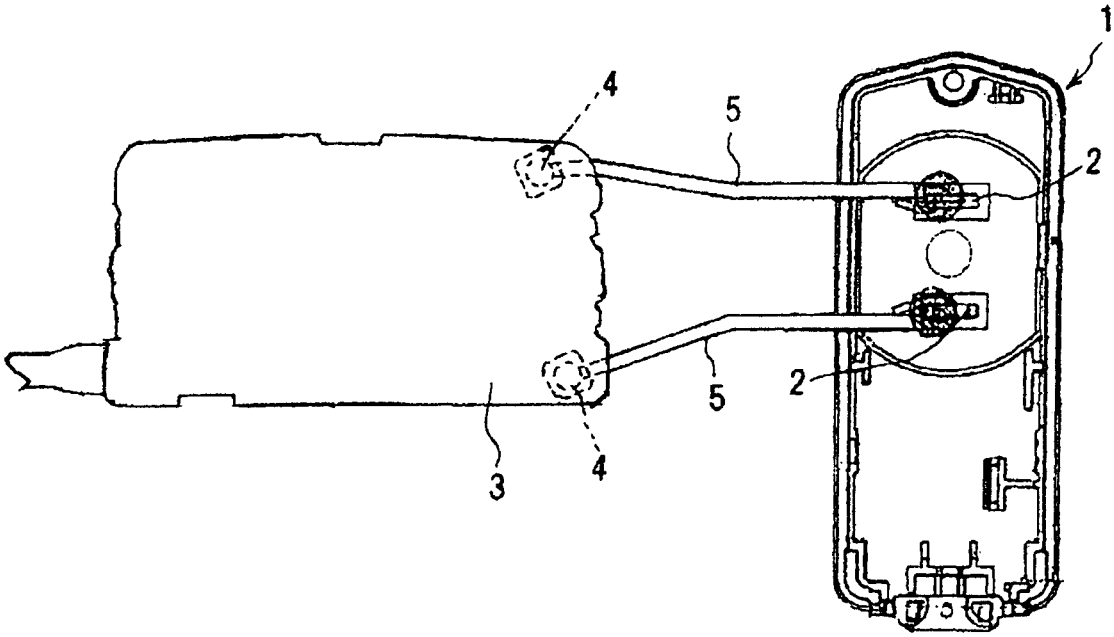
FIG. 9 is plane view of a conventional AC adaptor.

Another embodiment of the invention is shown in FIGS. 6 to 8. This embodiment is characterized in that positions where to form fixed contact pieces 15 and contact terminals 12 are moved to respective sides of a case 13 in a width direction and plug pins 14, 14 are each formed into a pin shape. In addition, like reference numerals are given to like members to those of the previous embodiment, and the detailed description thereof will be omitted here.

In this embodiment, too, the same function and advantage as those provided by the previous embodiment can be provided. Namely, when a printed circuit board 11 is built in the case 13 with the plugs 14, in the event that the printed circuit board 11 is inserted into a building-in position in the case 13 from a side of the case 13 opposite to a side where the plugs 14 are provided, the printed circuit board 11 is automatically fixed in the predetermined building-in position relative to the case 13 with respect to the width direction A and the thickness direction B by position restricting projections 17, 17A and position restricting projections 16.

Simultaneously, by contact terminals 12 on the printed circuit board 11 side being brought into press contact with fixed contact pieces 15 on the plugs 14 sides with a required elastic force, the stability in electrical contact between the contact terminals and the fixed contact pieces is ensured properly.

Note that the invention can be modified variously without departing from the spirit and scope of the invention, and needless to say, the invention contains all those modified embodiments. The position restricting projections 16 and the position restricting projections 17 may be formed integrally with the case 13, or independently from the case 13. The contact terminal 12 may be partly made of elastic material. The contact piece 15 may be provided integrally with the plug 14, or independently from the plug 14, as long as the contact piece 15 is electrically connected to the plug 14. The number of the position restricting projections 16 may be single, or a plurality of the position restricting projections 16 may be arranged in the inserting direction C, as long as the position restricting projections 16 can restrict the position of the circuit board 11 in the width direction. The position restricting projection 17 may be single, or a plurality of the position restricting projections 17 may be arranged in the inserting direction as long as the position restricting projections 17 can restrict the position of the circuit board 11 in the thickness direction. The stopper may be disposed so as to contact a side edge of the circuit board 11 in the inserting direction C, as long as the stopper can restrict the position of the circuit board 11 in the inserting direction C. In other words, the position restricting projection in the inserting direction C may not be disposed at the deepest position of the case 13. Moreover the stoppers and the position restricting projections 17 may be formed integrally with each other or independently from each other.

What is claimed is:

1. An AC adaptor, comprising:

a case;

a plug, extending from a face of the case in a first direction so as to penetrate a part of the case;

a circuit board, disposed within the case;

a contact terminal, disposed on the circuit board, and elastically contacting an end portion of the plug;

a first regulator, disposed within the case and regulating a position of the circuit board in a second direction orthogonal to the first direction;

a second regulator, disposed within the case and regulating the position of the circuit board in a third direction orthogonal to the first direction and the second direction; and a third regulator, regulating the position of the circuit board in the first direction and provided within the case at a deepest portion of the case at the face of the case where the plug extends, wherein the first regulator includes a pair of rails extending in the first direction, each of the pair of rails has a vertical portion extending from an inner surface of the case and a horizontal portion perpendicularly extends cantilevered from an upper end of the vertical portion, whereby the circuit board slidably fits between the pair of rails and on the horizontal portions at a lower side of the horizontal portions of each of the pair of rails.

2. The AC adaptor as set forth in claim 1, wherein:

the second regulator is protruded from an inner face of the case in the third direction.

3. The AC adaptor as set forth in claim 2, wherein:

the second regulator has a slope being away from the inner face of the case as being close to the plug.

4. The AC adaptor as set forth in claim 1, wherein:

the third regulator contacts a side edge of the circuit board in the first direction.

5. The AC adaptor as set forth in claim 1, wherein:

the contact terminal has a U shape including a bottom plate mounted on the circuit board and a pair of plates standing on the bottom plate and facing each other so as to clamp the end portion of the plug therebetween.

* * * * *